US006343852B1

(12) United States Patent
Yoon

(10) Patent No.: US 6,343,852 B1
(45) Date of Patent: Feb. 5, 2002

(54) APPARATUS FOR JETTING FLUID BY ELECTROSTATIC FORCE, AND METHOD OF MANUFACTURING THE SAME

(75) Inventor: Yong-seop Yoon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/440,198

(22) Filed: Nov. 15, 1999

(30) Foreign Application Priority Data

Nov. 16, 1998 (KR) ..... 98-49073

(51) Int. Cl.[7] ..... B41J 2/04
(52) U.S. Cl. ..... 347/54; 347/20; 347/112
(58) Field of Search ..... 347/54, 20, 68, 347/70, 71, 75, 112; 29/890.1; 216/27

(56) References Cited

U.S. PATENT DOCUMENTS 5,513,431 A * 5/1996 Ohno et al. ..... 29/890.1
5,652,609 A * 7/1997 Scholler et al. ..... 347/54

FOREIGN PATENT DOCUMENTS

JP 8-290567 11/1996

* cited by examiner

*Primary Examiner*—N. Le
*Assistant Examiner*—Shih-Wen Hsieh
(74) *Attorney, Agent, or Firm*—Staas & Halsey LLP

(57) ABSTRACT

An apparatus for jetting a fluid to an exterior through a nozzle by exerting a driving force to the fluid held within a jetting fluid chamber and method of manufacturing the same. The apparatus employs an electrostatic force as the driving force for a driving part which is to be exerted to the fluid. The driving part for exerting the driving force to the fluid has upper and lower electrodes which are oppositely spaced apart from each other at a predetermined distance. The upper electrode is disposed within the interior of a membrane. Here, the membrane forms the lower surface of the jetting fluid chamber. Accordingly, the membrane is driven by the upper electrode which is displaced upward and downward due to the electrostatic force generated between the upper and lower electrodes, so that the driving force is exerted to the fluid within the jetting fluid chamber, and the fluid is jetted to the exterior through the nozzle.

36 Claims, 10 Drawing Sheets

APPARATUS FOR JETTING FLUID BY ELECTROSTATIC FORCE, AND METHOD OF MANUFACTURING THE SAME

CROSS-REFERENCE TO RELATED APPLICATIONS

This application claims the benefit of Korean Application No. 98-49073, filed Nov. 16, 1998, in the Korean Patent Office, the disclosure of which is incorporated herein by reference.

BACKGROUND OF THE INVENTION

1. Field of the Invention

The present invention relates to an apparatus for jetting fluid, and method of manufacturing the same, and more particularly to a fluid jetting apparatus of a print head employed in output apparatuses such as an ink jet printer, a facsimile machine, etc., to jet fluid through a nozzle.

2. Description of the Related Art

A print head is a part or a set of parts which are capable of converting output data into a visible form on a predetermined medium using a type of printer. Generally, such a print head for an ink jet printer and the like, uses a fluid jetting apparatus which is capable of jetting a predetermined amount of fluid through a nozzle to an exterior of the ink jet printer or related device by applying a physical force to a fluid chamber holding the fluid.

According to a method for applying a physical force to the fluid within the fluid chamber, a fluid jetting apparatus is roughly grouped into a piezoelectric system and a thermal system. The piezoelectric system pushes the fluid within a fluid chamber through the nozzle by an operation of a piezoelectric element which is mechanically expanded in accordance with a driving signal. The thermal system pushes the fluid through the nozzle by bubbles which are produced in the fluid within a fluid chamber due to heat generated by an exothermic body. Recently, also, a thermal compression system has been developed, which is an improved form of the thermal system. The thermal compression system jets the fluid by driving a membrane by instantly heating a vaporizing fluid which acts as a working fluid.

FIG. 1 is a vertical sectional view of a fluid jetting apparatus according to a conventional thermal compression system. A fluid jetting apparatus of the thermal compression system includes a heat driving part 10, a membrane 20, and a nozzle part 30. Referring to the heat driving part 10, a reference numeral 11 is a silicon substrate, 12 is a nonconductive layer, 13 is an exothermic body, and 14 is an electrode. The reference numeral 15 is a barrier layer for a working fluid, 16 and 17 are working fluid chambers, and 18 is a passage for introduction of the working fluid.

Referring to the membrane 20, a reference numeral 21 is a polyimide coated layer, and 22 is a polyimide adhered layer.

Referring to the nozzle part 30, a reference numeral 34 is a nozzle plate, 35 is a nozzle, 36 is a barrier layer of jetting fluid. Reference numerals 37 and 38 are jetting fluid chambers, and 39 is a passage for introduction of the jetting fluid.

The substrate 11 of the heat driving part 10 supports the heat driving part 10 and the whole, complete, structure that will be constructed later. The electrode 14 is a conductive material for supplying an electric power for the heat driving part 10. The exothermic body 13 is a resistive material having a predetermined resistance for expanding a working fluid by converting electrical energy into thermal energy. The working fluid chambers 16 and 17 contain the working fluid, to maintain the pressure of the working fluid which is expanded by the heat.

Further, the membrane 20 is a thin layer which is adhered to an upper portion of the working fluid chambers 16 and 17, and is moved upward and downward by the pressure of the expanded working fluid. The membrane 20 includes a polyimide coated layer 21 and a polyimide adhered layer 22.

The jetting fluid chambers 37 and 38 are formed in a jetting fluid barrier layer **3*b* to contain the jetting fluid, and designed to jet the fluid only through a nozzle 35 when the pressure transmitted through the membrane 20 is applied to the jetting fluid. Here, the jetting fluid is the fluid which is pushed out of the jetting fluid chambers 37 (through the nozzle 35) and 38 (via the jetting passage 39) in response to the driving of the membrane 20, and finally jetted to the exterior. The nozzle 35 is an orifice through which the jetting fluid held within the jetting fluid chambers 37 and 38 is emitted to the exterior. A substrate (not shown) of the nozzle part 30 is temporarily employed for constructing the nozzle part 30, and the substrate of the nozzle part 30 should be separated before the nozzle part 30** is assembled.

A process of manufacturing the fluid jetting apparatus according to the conventional thermal compression system will be described below.

FIGS. 2A to 2C are views for showing a process of manufacturing the heat driving part 10 and the membrane 20 of the fluid jetting apparatus of the prior art. FIGS. 3A to 3C are views for showing a process for manufacturing the nozzle part 30.

In order to manufacture the conventional fluid jetting apparatus, the heat driving part 10 and the nozzle part 30 should be separately manufactured. Here, the heat driving part 10 is completed and the separately-made membrane 20 is adhered to the substrate 11 of the heat driving part 10. After that, by reversing and adhering the separately-made nozzle part 30, the fluid jetting apparatus is completed.

FIG. 2A shows a sequential process of diffusing the insulated (non-conductive) layer 12 on the substrate 11 of the heat driving part 10, for forming the exothermic body 13 and the electrode 14 thereon. FIG. 2B shows a process of performing an etching process through a predetermined mask patterning to make the working fluid chambers 16 and 17 and the passage 18 for introduction of the working fluid. More specifically, the heat driving part 10 is formed as the insulated layer 12, the exothermic body 13, the electrode 14, and the barrier layer 15 for the working fluid are sequentially laminated on the upper portion of the silicon substrate 11. In such a situation, the working fluid chambers 16 and 17, formed on the etched portion of the working fluid barrier layer 15, are filled with the working fluid to be expanded by heat. The working fluid is introduced through the passage 18 for introduction of the working fluid.

FIG. 2C shows a process of adhering the separately-made membrane 20 to the upper portion of the completed heat driving part 10. The membrane 20 is a thin diaphragm, which is to be driven toward a direction of the jetting fluid chamber 37 by the working fluid which is heated by the exothermic body 13.

FIG. 3A shows a process of forming an insulated layer 32 and the nozzle plate 34 on the upper portion of the substrate 31 of the nozzle part 30, and then forming the nozzle 35 by a laser processing equipment (not shown). FIG. 3B shows a sequential process of forming the jetting fluid barrier layer 36 on the upper portion of the construction shown in FIG.

3A, of forming the jetting fluid chambers 37 and 38 and the fluid introducing passage 39 by an etching process through a predetermined mask patterning. FIG. 3C shows a process of exclusively separating the nozzle part 10 from the substrate 31 of the nozzle part 30. The nozzle part 30 includes the jetting fluid barrier layer 36 and the nozzle plate 34. On the etched portion of the jetting fluid barrier layer 36, the jetting fluid chambers 37 and 38 to be filled with the jetting fluid, are formed. The jetting fluid such as ink and the like is introduced through the jetting fluid introducing passage 39. The nozzle 35 is formed on the nozzle plate 34 to be interconnected with the jetting fluid chamber 37, so that the jetting fluid is jetted through the nozzle 35.

The operation of the fluid jetting apparatus according to the thermal compressions system will be described with reference to the above-mentioned FIG. 1.

First, an electric power is supplied through the electrode 14, and electric current flows through the exothermic body 13 which is connected to the electrode 14. In such a situation, the exothermic body 13 generates heat due to its resistance. The working fluid within the working fluid chamber 16 is subjected to a resistance heating, so that the working fluid starts to vaporize when the temperature thereof exceeds a predetermined degree. As the amount of the working fluid vaporized by the heat increases, the vapor pressure increases. As a result, the membrane 20 is driven upward. More specifically, as the working fluid undergoes the thermal expansion, the membrane 20 is pushed upward in a direction indicated by the arrow in FIG. 1. As the membrane 20 is pushed upward, the jetting fluid within the jetting fluid chamber 37 is jetted to the exterior through the nozzle 35.

Then, when the supply of the electric power is stopped, the resistance heating is no longer generated out of the exothermic body 13. Accordingly, the working fluid within the working fluid chamber 16 is cooled to a liquid state, so that the volume thereof decreases and the membrane 20 recovers its original shape.

Meanwhile, a conventional material used for the nozzle plate 34 is mainly nickel, but the trend in using a material of a polyimide synthetic resin has increased recently. When the nozzle plate 34 is made of the polyimide synthetic resin, it is fed by a reel type. The fluid jetting apparatus is completed by the way a chip laminated from the silicon substrate 11 to the jetting fluid barrier layer 36 is bonded on the nozzle plate 34 in the reel type.

The conventional fluid jetting apparatuses, however, have the following drawbacks.

First, since a piezoelectric element is expensive, the fluid jetting apparatus becomes expensive if the same employs the piezoelectric element. Second, if the fluid jetting apparatus employs a thermal system, or a thermal compression system, then the responsive quality thereof can not be guaranteed due to its mechanism in which the working fluid is heated, vaporized, and then thermally expanded, to generate a pressure for exerting the physical force to the fluid. More specifically, since the working fluid should be heated and then vaporized to generate the pressure for driving the membrane, the responsive quality of the fluid jetting apparatus deteriorates.

Third, if the fluid jetting apparatus employs the thermal compression system, a precision process of forming the working fluid introducing passage, and also, the process of introducing the working fluid into the working fluid chamber, are required. This causes productivity to be decreased. Finally, due to the high vapor pressure which is produced while heating the working fluid, leakage may occur between the working fluid chamber and the membrane, or between the working fluid chamber and the substrate, so that the reliability of the fuel jetting apparatus deteriorates.

SUMMARY OF THE INVENTION

The present invention has been made to overcome the above-described problems of the related art, and accordingly it is a first object of the present invention to provide an apparatus for jetting fluid which employs an electrostatic force and has a greater responsiveness than a fluid jetting apparatus according to a thermal system or a thermal compression system.

A second object of the present invention is to provide an apparatus for jetting fluid which employs an electrostatic force for jetting fluid regardless of the property of the fluid by driving an organic membrane with an electrostatic attraction.

In order to accomplish the first object, the present invention provides an apparatus for jetting fluid comprising a lower electrode, a membrane, a jetting fluid chamber which contains the fluid, a nozzle, and means including the membrane and the lower electrode, for exerting a driving force to the fluid within the jetting fluid chamber by generating an electrostatic force between the membrane and the lower electrode so as to jet a predetermined amount of the fluid outside of the nozzle.

Here, the exerting means further includes an upper electrode so that the upper electrode and the lower electrode are oppositely spaced apart from each other by a predetermined distance. It is preferable that the exerting means exerts the driving force to the fluid within the jetting fluid chamber by the displacement of the upper electrode upward and downward due to the electrostatic force generated between the upper and lower electrodes.

It is preferable that the upper electrode is disposed in an interior of the membrane to exert the driving force to the fluid within the jetting fluid chamber by driving the membrane.

The membrane has a lower membrane and an electrically conducting metallic layer is formed on the upper surface of the lower membrane. Further, it is preferable that the electrically conductive metallic layer is inserted into the membrane, while being disposed between the lower membrane and an upper membrane, to maintain a secure bond of the metallic layer with the upper and lower membranes which are organic layers.

Also, the metallic layer comprises an upper electrode in the form of a plate, and at least two springs.

It is still preferable that the upper electrode is supported by the membrane and is applied with the electric power through the at least two springs which are shaped to have less stiffness than if the springs are totally straight.

Here, the exerting means further includes a space layer for maintaining a gap defined between the upper and lower electrodes.

In order to accomplish the second object, a fluid jetting apparatus for employing an electrostatic force according to the present invention includes a jetting fluid chamber with a nozzle and a lower surface comprising a membrane, and in which the fluid is accommodated; a lower electrode disposed at a lower side of the membrane; a space layer to maintain a gap between the membrane and the lower electrode; and an upper electrode disposed within the membrane, to drive the membrane by the electrostatic force generated between the lower electrode and the upper electrode in response to the electric power being applied thereto so as to jet the fluid through the nozzle.

The apparatus for jetting fluid by the electrostatic force according to the present invention, employs the electrostatic force as a driving force exerted to the fluid. The driving force is exerted to the fluid by the upper and lower electrodes which are oppositely spaced apart from each other by a predetermined distance. The upper electrode is disposed within the membrane which forms the lower surface of the jetting fluid chamber. Accordingly, the membrane is driven by the upper electrode which is displaced upward and downward due to the electrostatic force generated between the upper and lower electrodes, so that the driving force is exerted on the fluid within the jetting fluid chamber and the fluid is jetted out through the nozzle.

BRIEF DESCRIPTION OF THE DRAWINGS

The above objects and advantages will be more apparent by describing the preferred embodiment in greater detail with reference to the accompanied drawings, in which.

DETAILED DESCRIPTION OF THE PREFERRED EMBODIMENT

Figure 1:
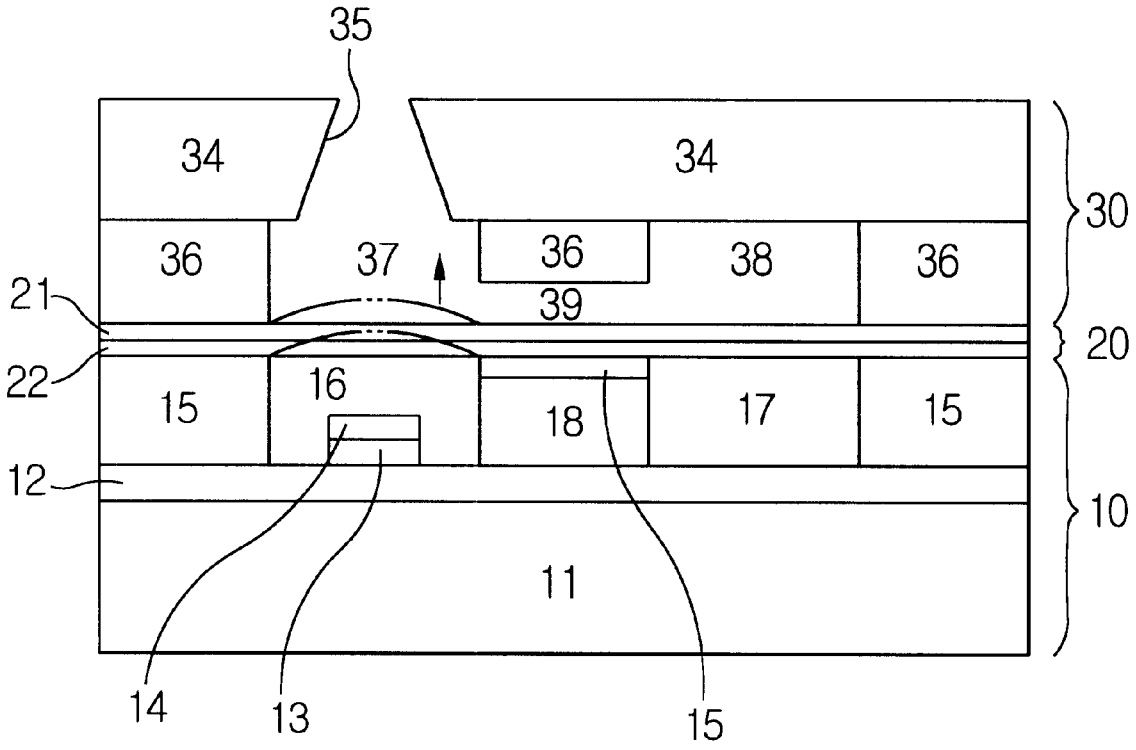
FIG. 1 (PRIOR ART)
FIG. 1 is a vertical sectional view showing a construction of an apparatus for jetting fluid according to a conventional thermal compression system.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Figure 4:
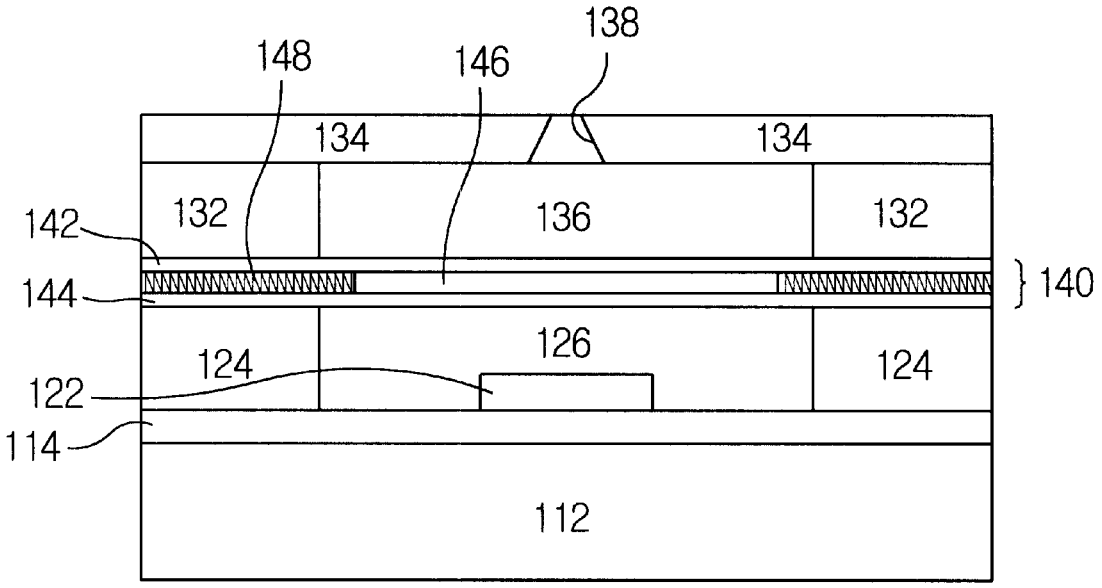
FIG. 4 is a vertical sectional view of an apparatus for jetting fluid employing an electrostatic force according to an embodiment of the present invention.

FIG. 4 is a vertical sectional view of the apparatus employing an electrostatic force according to the embodiment of the present invention.

A reference numeral 112 is a silicon substrate, 114 is an insulating layer, and 122 is a lower electrode. The reference numeral 124 is a space barrier layer, 126 is a space layer, and 132 is a jetting fluid barrier layer. The reference numeral 134 is a nozzle plate, 136 is a jetting fluid chamber, and 138 is a nozzle. The reference numeral 140 is a membrane, 142 is an upper membrane member, 144 is a lower membrane member, 146 is an upper electrode, and 148 represents springs.

As shown in FIG. 4, the fluid jetting apparatus according to the embodiment of the present invention has a structure in which the insulating layer 114, the lower electrode 122, the space barrier layer 124, the membrane 140, the jetting fluid barrier layer 132, and the nozzle plate 134 are sequentially laminated on the silicon substrate 112.

A heat driving part is formed with the lower electrode 122 and the membrane 140 is formed on the space barrier layer 124. The jetting fluid chamber 136 is formed between the nozzle plate 134, the jetting fluid barrier layer 132, and the membrane 140. Fluid is held within the jetting fluid chamber 136. The nozzle 138 is formed in the nozzle plate 134, so that the fluid within the jetting fluid chamber 136 is jetted there through.

Figure 5A:
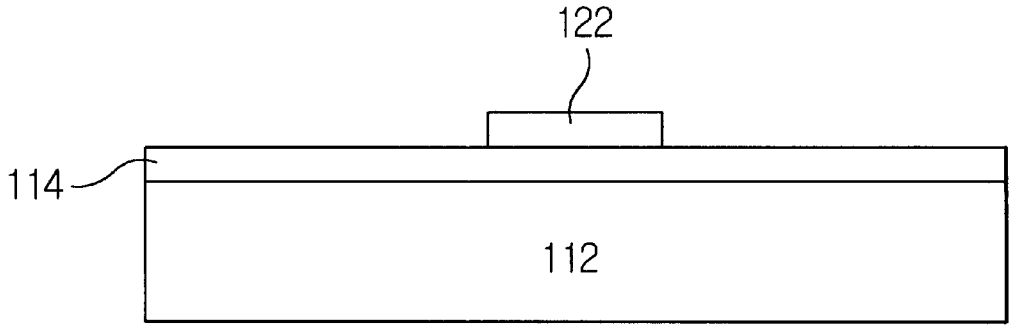
FIGS. 5A to 5C are views showing a manufacturing process of a heat driving part and a membrane of a fluid jetting apparatus employing the electrostatic force according to the embodiment of the present invention.
Figure 5B:
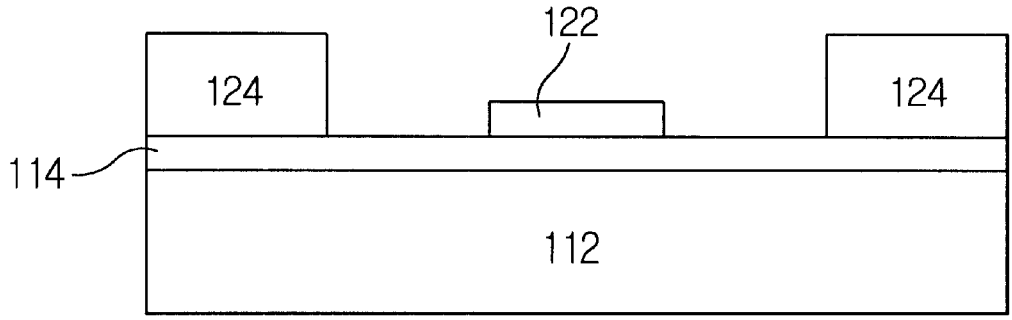
Figure 5C:
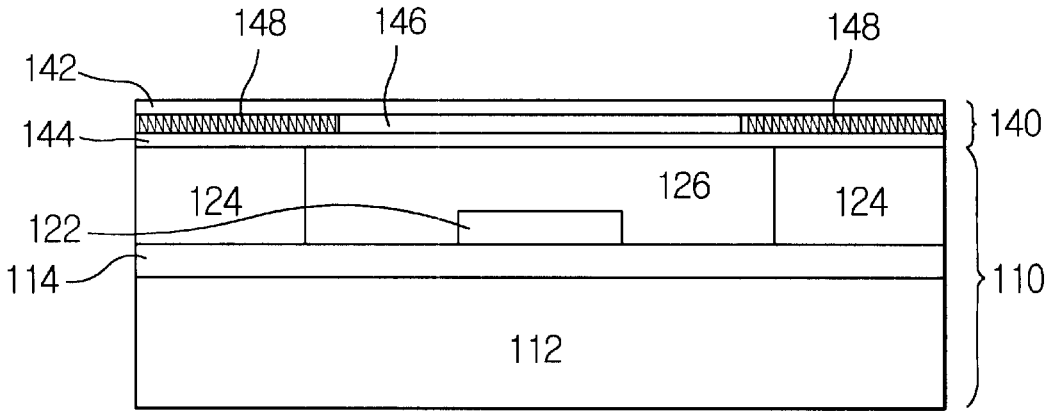

FIGS. 5A to 5C are views showing a manufacturing process of the heat driving part and the membrane of a fluid jetting apparatus employing the electrostatic force according to the present invention.

Figure 2A:
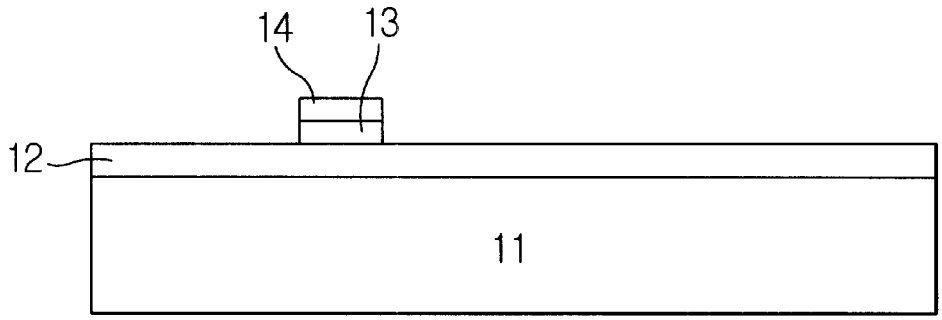
FIG.2A (PRIOR ART)
FIGS. 2A to 2B are views showing a manufacturing process of a heat driving part and FIG. 2C is a view showing a manufacturing process of adhering a membrane to the heat driving part of the conventional fluid jetting apparatus shown in FIG. 1.
Figure 2B:
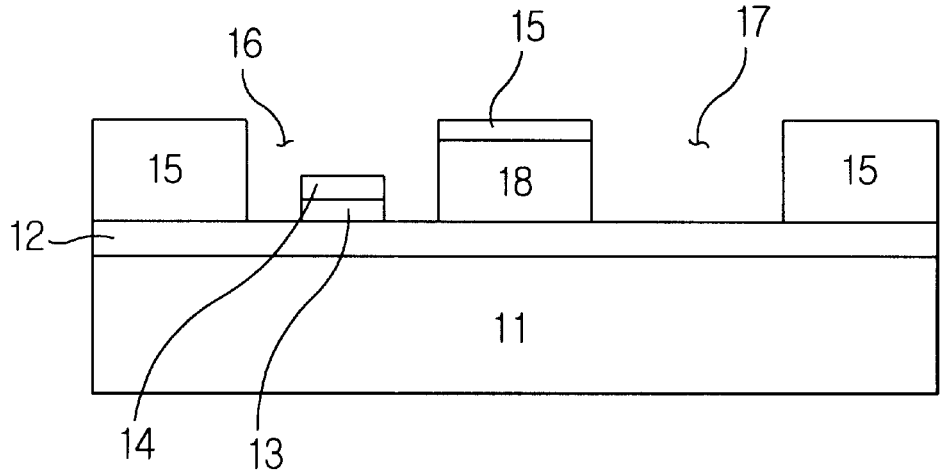
FIG.2B (PRIOR ART)
Figure 2C:
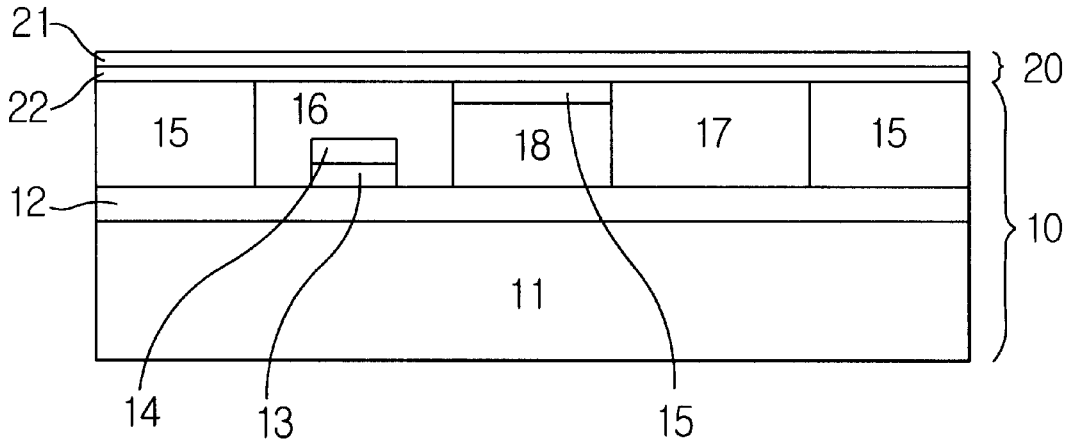
FIG.2C (PRIOR ART)
Figure 3A:
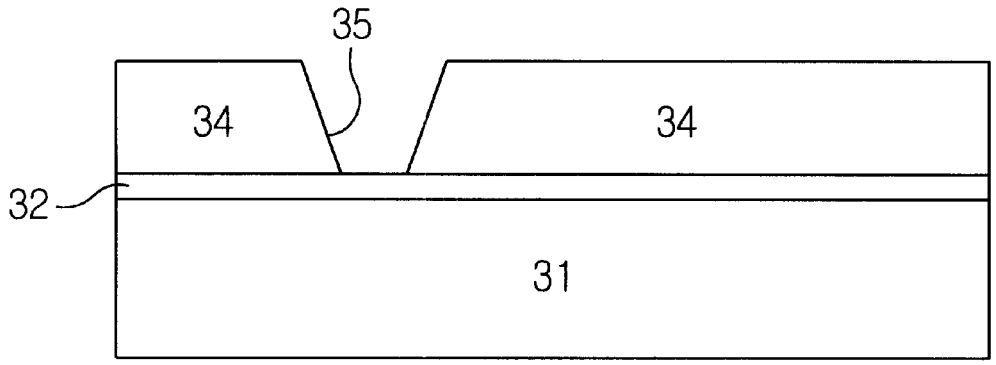
FIG.3A (PRIOR ART)
FIGS. 3A to 3C are views showing a manufacturing process of a nozzle part of the conventional fluid jetting apparatus shown in FIG. 1.
Figure 3B:
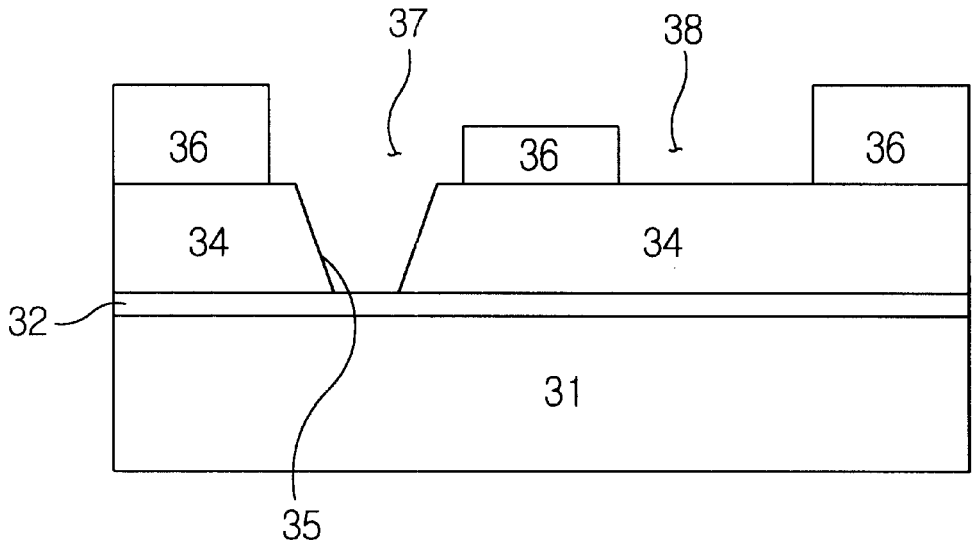
FIG.3B (PRIOR ART)
Figure 3C:
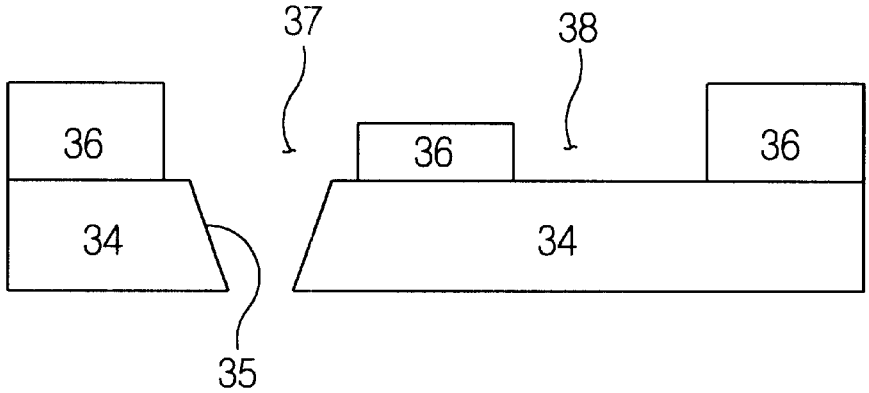
FIG.3C (PRIOR ART)

Referring to FIG. 5A, the insulating layer 114 is formed on the upper portion of the substrate 112 of the heat driving part, and then the lower electrode 122 is formed on the upper portion of the insulating layer 114. To form the lower electrode 122, an electrically conductive metal is vapor-deposited on the substrate 112 to which the insulating layer 114 is vapor-deposited, and the lower electrode 122 is made through the photo-etching process. Unlike the conventional thermal compression system, no exothermic body is required. Now, referring to FIG. 5B, in the state as shown in FIG. 5A, the space barrier layer 124 is formed on the uppermost portion of the insulating layer 114, and the space layer 126 is formed by the etching process through the mask patterning. That is, the space barrier layer 124 is formed by a photo-etching process wherein a polyimide, which is an organic film, is applied on the insulating layer 114 which is applied to the substrate 112 formed with the lower electrode 122. At this time, a working fluid chamber and an introducing passage of the working fluid are not formed as they are in the conventional system shown in FIGS. 1 and 2B, and which are shown as the space layer 126. FIG. 5C shows the state in which the membrane 140 is bonded to the space barrier layer 124. The membrane 140 has a structure in which the upper electrode 146 is disposed between the upper membrane member 142 and the lower membrane member 144.

The upper electrode 146 and the springs 148 are made through a photo-etching process, by vapor-depositing electrically conductive metallic layer on the upper portion of the lower membrane member 144. Then, the upper membrane member 142 is formed by applying an organic film on the metallic layer comprising the upper electrode 146 and the springs 148 for better adhesive strength. Here, the upper membrane 142 may be omitted, so that the upper electrode 146 and the springs 148 only may be made on the lower membrane 144.

The upper and lower membrane members 142 and 144 are formed of an organic material such as a polyimide. The upper and lower membrane members 142 and 144 function to prevent direct contact of the fluid within the jetting fluid chamber 136 with the upper electrode 146, and are easily adhered to the jetting fluid barrier layer 132 and the space barrier layer 124.

Figure 6:
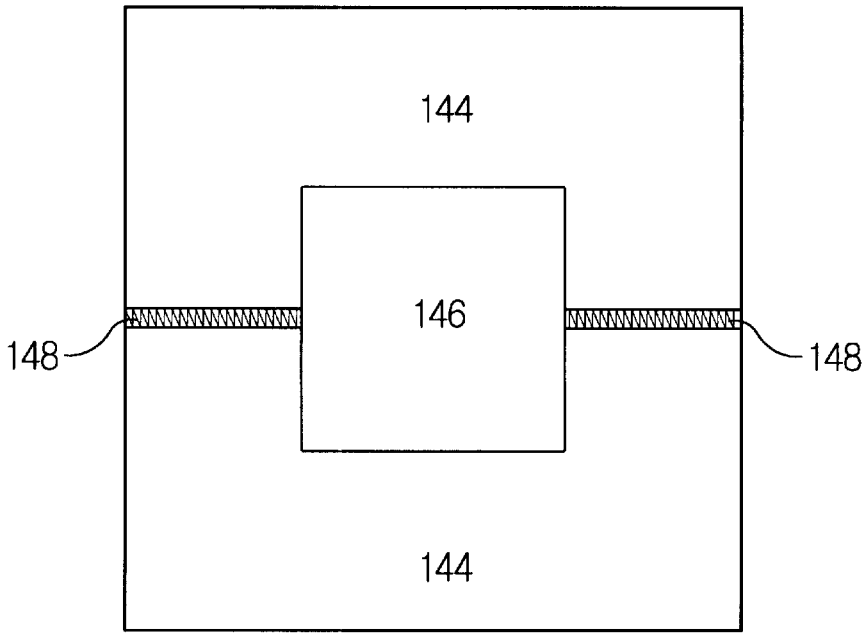
FIG. 6 is a plan view of an upper electrode shown in FIG. 5 according to a first aspect of the present invention.
Figure 7:
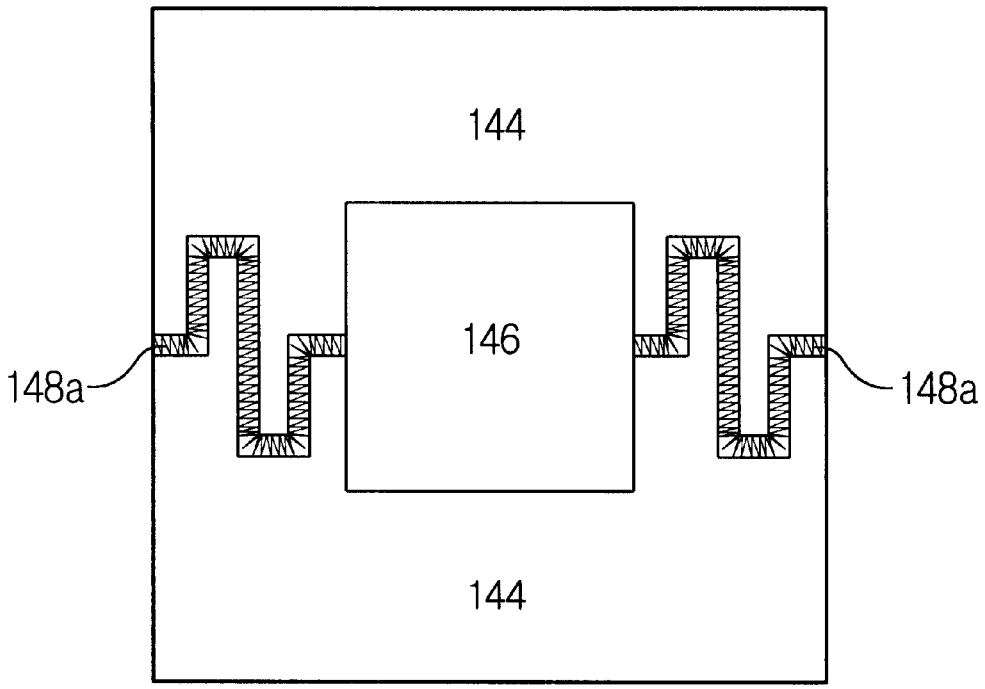
FIG. 7 is a plan view of the upper electrode shown in FIG. 5 according to a second aspect of the present invention.

FIG. 6 is a plan view of the upper electrode 146 shown in FIG. 5 according to a first aspect of the present invention, and FIG. 7 is a plan view of the upper electrode 146 shown in FIG. 5 according to a second aspect of the present invention.

The upper electrode 146 is a thin elastically conductive metallic layer which has a predetermined elasticity. As shown in FIG. 6, the size of the upper electrode 146 is slightly less than that of the lower membrane member 144 (in FIG. 6, the upper membrane member 142 is not shown). Further, at least two springs 148 are electrically connected to the upper electrode 146. Through the springs 148, electric power is applied. Additionally, as shown in FIG. 7, it is preferable that the springs 148 have geometrical shapes to have less stiffness, such as being redirected into a plurality of bent portions. In such a situation, since the stiffness of the springs 148 is decreased, the membrane 140 is enabled to be driven more easily. The space barrier layer 124 is for maintaining a gap defined between the upper and lower electrodes 146 and 122.

The operation of the fluid jetting apparatus constructed as above according to the embodiment of the present invention will be described below. Here, since the construction and operation of the nozzle part are the same as described above, with regard to the conventional thermal compression system any further description thereof will be omitted.

Figure 8:
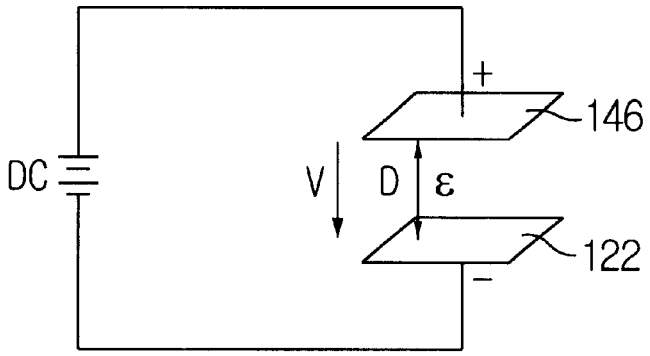
FIG. 8 is circuit diagram for explaining how the fluid jetting apparatus is operated by the electrostatic force according to the embodiment of the present invention.

FIG. 8 is a circuit diagram for explaining how the fluid jetting apparatus according to the embodiment of the present invention is operated by electrostatic force.

As electric power is applied to the upper and lower electrodes 146 and 122, a potential difference is generated therebetween, so that an electrostatic force is produced. The electrostatic force is given by:

$$F=\epsilon A\ V^2/2D^2$$

Here, V is the potential difference between the upper and lower electrodes 146 and 122, D is the distance between the upper and lower electrodes 146 and 122, and A is the area of the upper electrode 146. $\epsilon$ is the permittivity between the upper and lower electrodes 146 and 122, and F is the electrostatic attractive force between the upper and lower electrodes 146 and 122. The maximum electrostatic force between the lower and upper electrodes 122 and 146 can be expressed by Fmax=2 kd, where k is the elastic modulus of the spring 148, and d is the maximum displacement of the membrane 140. In this situation, the distance between the lower and upper electrodes 122 and 146 is the same as the distance that the maximum displacement of the membrane 140 is subtracted from the distance between the lower and upper electrodes 122 and 146 when the electric power is not applied thereto.

In such a situation, as the electrostatic attractive force acts with respect to the whole area of the upper electrode 146, the force is transmitted toward the lower membrane member 144 and the springs 148. The force transmitted to the lower membrane member 144, then drives the membrane 140 in the direction of the force. As the membrane 140 is moved 10 downward, the ink is injected into the jetting fluid chamber 136 by the amount which is corresponding to the extended volume. Then when the electric power is turned off, the membrane 140 recovers its original shape, so that the injected ink is jetted out. In order to make the deformation of the membrane 140 much greater, the force itself has to be increased, and at the same time, most of the force should be used to drive the membrane 140.

In order to increase the force, A, V and $\epsilon$ should be increased while D should be decreased based on the above-described formula, and these factors, in practice, are not freely varied due to the limit in design. Since the factor D can be adjusted by freely adjusting the speed of applying the organic layer, the adjustment of the force is rather easier. In this instance, the faster the application speed of the organic layer (i.e., the space layer 124) gets for a predetermined period, the thinner the thickness of the space barrier layer 124, so that the distance D between the lower and upper electrodes 122 and 145 is narrowed. To the contrary, the slower the application speed of the organic layer gets, the thicket the thickness of the space layer 124 ism so that the distance D is widened. Further, in order to use most of the force to drive the membrane 140, the stiffness of the springs 148 should be decreased. That is, the springs 148 may well only serve as electric wires that the electric current flows through, rather than having the ordinary function of the spring. Accordingly, the stiffness of the springs 148 should be decreased to the extent as possible, by varying the geometrical structure and thickness thereof.

Figure 9:
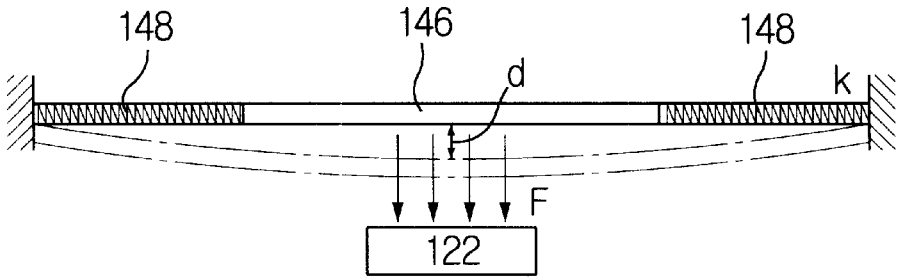
FIG. 9 is a view showing the simplified structure of the fluid jetting apparatus employing the electrostatic force according to the embodiment of the present invention.

FIG. 9 shows a simplified structure of the fluid jetting apparatus employing the electrostatic force according to the embodiment of the present invention. According to FIG. 9, a predetermined voltage is applied between the upper and lower electrodes 146 and 122, the upper electrode 146 is supported and displaced by the springs 148 at both sides thereof, the electrostatic attractive force F is applied, so that the upper electrode 146 is moved within the limit of the maximum displacement d. At this time, ink enters the jetting fluid chamber 136. Then, when the electric power is turned off, the upper electrode 146 is moved upward, and the upper electrode 146 pushes the ink within the jetting fluid chamber 136 through the nozzle 138.

Figure 10A:
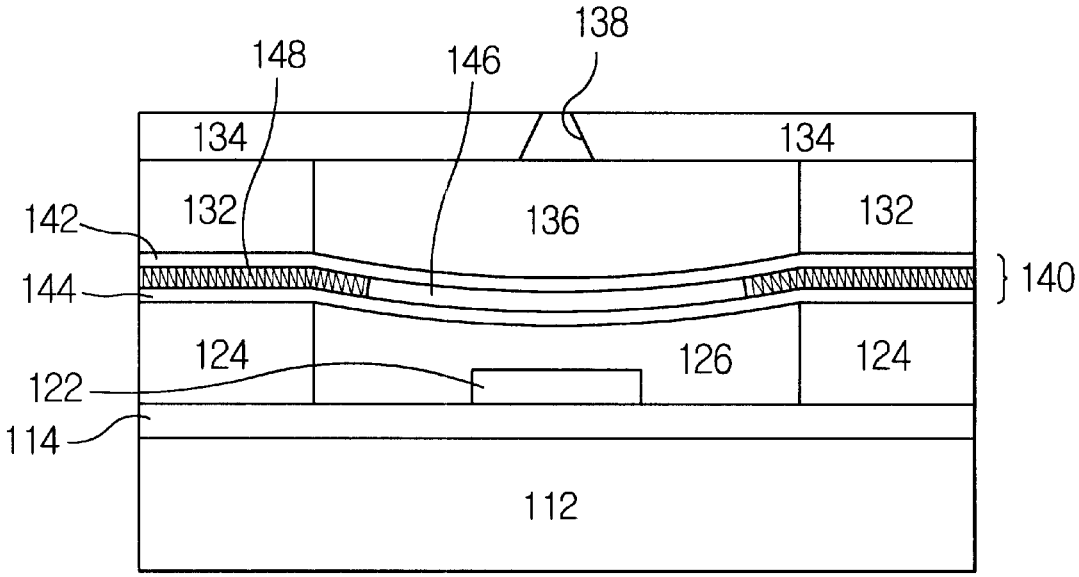
FIGS. 10A and 10B are sectional views showing the respective states that an electric power is turned on/off between the upper and lower electrodes of the fluid jetting apparatus employing the electrostatic force according to the embodiment of the present invention.
Figure 10B:
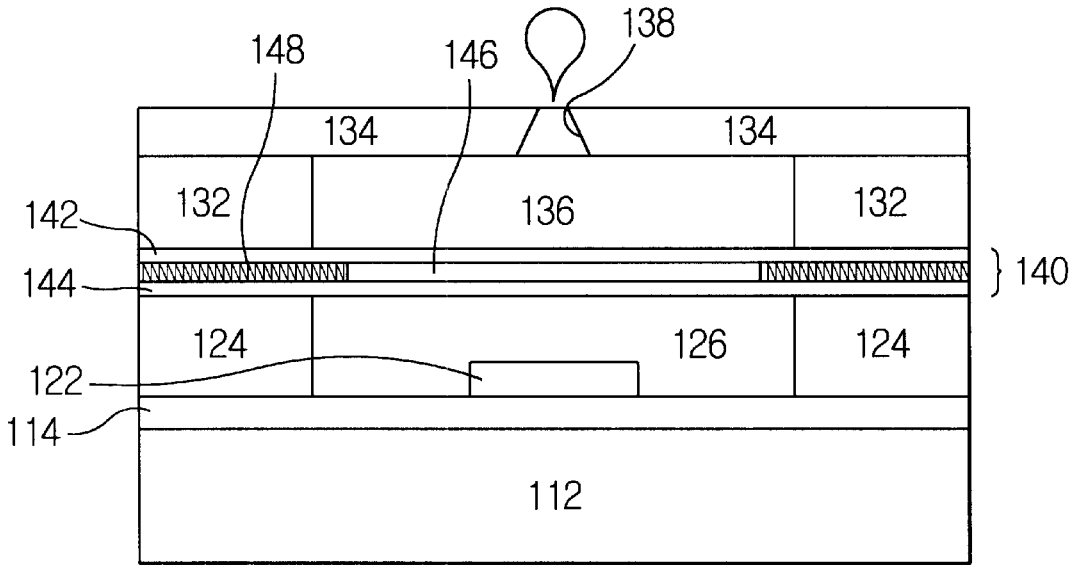

FIGS. 10A and 10B are sectional views of the respective states that the electric power is turned on/off between the upper and lower electrodes 146 and 122 of the fluid jetting apparatus employing the electrostatic force according to the embodiment of the present invention.

According to FIG. 10A, the electrostatic force is applied to the whole area of the upper electrode 146, and the membrane 140 is deformed downward. As the membrane 140 is deformed, the volume of the jetting fluid chamber 136 is increased, and the jetting fluid is introduced into the jetting fluid chamber 136 through a jetting fluid introducing passage (not shown) by the amount which corresponds to the increased volume.

In such a situation, as the electric power is turned off, the electrostatic force is dissipated. Accordingly, as shown in FIG. 10B, the membrane 140, inclusive of the upper electrode 146, recovers its original shape by its elasticity. As the membrane 140 recovers its original shape, the introduced ink is ejected to the exterior through the nozzle 138.

As a result, the apparatus for jetting fluid according to the present invention jets the fluid out of the nozzle 138 by driving the membrane 140 with the electrostatic force which is generated when electric power is applied between the two electrodes 146 and 122. Accordingly, the fluid jetting apparatus according to the present invention can be manufactured with less manufacturing costs in comparison with the fluid jetting apparatuses according to the conventional piezoelectric system, because the expensive piezoelectric elements are not used. Also, the responsiveness of the fluid jetting apparatus according to the present invention is better than the thermal system, or the thermal compression system. Finally, unlike the thermal compression system, a working fluid chamber is not required according to the present invention, so that the working fluid may not be leaked and reliability is enhanced.

Having illustrated and described the principles of the invention, it should be apparent to those persons skilled in the art that the illustrated embodiment and the various aspects thereof may be modified without departing from such principles. We claim as our invention all such embodiments that may come within the scope and spirit of the following claims and equivalents thereto.

What is claimed is:

1. An apparatus for jetting fluid by employing an electrostatic force, comprising:

a lower electrode;

a membrane;

a jetting fluid chamber which contains the fluid;

a nozzle; and means, including the membrane and the lower electrode, for exerting a driving force to the fluid within the jetting fluid chamber by generating the electrostatic force between the membrane and the lower electrode so as to jet a predetermined amount of the fluid to outside of the nozzle, the exerting means further comprising an upper electrode oppositely spaced from the lower electrode by a predetermined distance, and the driving force is exerted to the fluid within the jetting fluid chamber by an upward and downward displacement of the upper electrode due to the electrostatic force, wherein the upper electrode is disposed in an interior of the membrane to exert the driving force to the fluid within the jetting fluid chamber by driving the membrane.

2. The apparatus as claimed in claim 1, wherein the exerting means further comprises a space layer for maintaining a gap between the upper and lower electrodes.

3. The apparatus as claimed in claim 1, wherein the membrane comprises an electrically conductive metallic layer on an upper surface thereof the upper surface including an upper electrode.

4. The apparatus as claimed in claim 1, wherein the membrane comprises:

a lower membrane;

an upper membrane; and an electrically conductive metallic layer disposed between the lower and upper membranes, to maintain a secure bond between the electrically conductive metallic layer and the upper and lower membranes, wherein the upper and lower membranes each comprise an organic layer.

5. An apparatus for jetting fluid by employing an electrostatic force, comprising:

a lower electrode;

a membrane comprising an electrically conductive metallic layer on an upper surface thereof, the upper surface including an upper electrode;

a jetting fluid chamber which contains the fluid;

a nozzle; and means, including the membrane and the lower electrode, for exerting a driving force to the fluid within the jetting fluid chamber by generating the electrostatic force between the membrane and the lower electrode so as to jet a predetermined amount of the fluid to outside of the nozzle, wherein the electrically conductive metallic layer includes the upper electrode in the form of a plate and at least two springs.

6. An apparatus for jetting fluid by employing an electrostatic force, comprising:

a lower electrode;

a membrane;

a jetting fluid chamber which contains the fluid;

a nozzle; and means, including the membrane and the lower electrode, for exerting a driving force to the fluid within the jetting fluid chamber by generating the electrostatic force between the membrane and the lower electrode so as to jet a predetermined amount of the fluid to outside of the nozzle, wherein the membrane comprises:

a lower membrane;

an upper membrane; and an electrically conductive metallic layer disposed between the lower and upper membranes, to maintain a secure bond between the electrically conductive metallic layer and the upper and lower membranes, wherein the upper and lower membranes each comprise an organic layer, and wherein the electrically conductive metallic layer includes an upper electrode in the form of a plate and at least two springs.

7. An apparatus for jetting fluid by employing an electrostatic force, comprising:

a lower electrode;

a membrane;

a jetting fluid chamber which contains the fluid;

a nozzle; and means, including the membrane and the lower electrode, for exerting a driving force to the fluid within the jetting fluid chamber by generating the electrostatic force between the membrane and the lower electrode so as to jet a predetermined amount of the fluid to outside of the nozzle, the exerting means further comprising an upper electrode so that the upper electrode and the lower electrode are oppositely spaced apart from each other by a predetermined distance, and the driving force is exerted to the fluid within the jetting fluid chamber by an upward and downward displacement of the upper electrode due to the electrostatic force, wherein the upper electrode is disposed in an interior of the membrane to exert the driving force to the fluid within the jetting fluid chamber by driving the membrane, and the upper electrode is supported by the membrane and is applied with an electric power through at least two springs, each spring having less stiffness than if the spring were completely linear.

8. An apparatus for jetting fluid by employing an electrostatic force, comprising:

a jetting fluid chamber to accommodate the fluid to be jetted, the jetting fluid chamber having a nozzle and a lower surface comprised of a membrane;

a lower electrode disposed at a lower side of the membrane;

a space layer to maintain a gap between the membrane and the lower electrode; and an upper electrode disposed within the membrane, to drive the membrane by the electrostatic force generated between the lower electrode and the upper electrode in response to electric power being applied thereto so as to jet the fluid through the nozzle.

9. An apparatus for jetting fluid; comprising:

a jetting fluid chamber to store the fluid;

a drive unit to generate an electrostatic force, and in response to the electrostatic force, change a volume of the jetting fluid chamber to jet the fluid from the jetting fluid chamber;

a membrane which forms a wall of the jetting fluid chamber; and a first electrode spaced apart from the membrane, wherein the membrane and first electrode generate the electrostatic force in response to a voltage applied therebetween to move the membrane.

10. The apparatus as claimed in claim 9, wherein the drive unit further comprises:

a substrate;

an insulating layer formed on the substrate and on which the first electrode is formed; and a spacing barrier layer formed on the insulating layer to maintain a distance between the membrane and the first electrode, the spacing barrier layer having a space formed therein such that the first electrode is formed within the space, and a portion of the membrane moves into the space in response to the electrostatic force.

11. The apparatus as claimed in claim 10 further comprising:

a jetting fluid barrier layer formed on the membrane, to form side walls of the jetting fluid chamber; and a nozzle part having a nozzle plate with a nozzle, to form another wall of the jetting fluid chamber.

12. The apparatus as claimed in claim 11, wherein the membrane comprises:

a second electrode, wherein the first and second electrodes generate the electrostatic force therebetween.

13. The apparatus as claimed in claim 12, wherein the membrane further comprises:

a first membrane layer made of a non-conductive material on which the second electrode is formed, and which is formed on the space barrier layer.

14. The apparatus as claimed in claim 13, wherein the membrane further comprises an electrically conductive metallic layer which includes the second electrode and springs connected to the second electrode.

15. The apparatus as claimed in claim 14, wherein the membrane further comprises:

a second membrane layer made of a non-conductive material and formed on the second electrode and springs, wherein the jetting fluid barrier layer is formed on the second membrane layer.

16. The apparatus as claimed in claim 15, wherein the first and second membrane layers are made of an organic material.

17. The apparatus as claimed in claim 14, wherein the springs are completely linear.

18. The apparatus as claimed in claim 14, wherein each spring is formed of bent segments.

19. The apparatus as claimed in claim 14, wherein the second electrode has an area less than that of the first membrane layer.

20. The apparatus as claimed in claim 9, wherein the membrane comprises:

a second electrode, wherein the first and second electrode generate the electrostatic force therebetween.

21. The apparatus as claimed in claim 20, wherein the membrane further comprises:

a first membrane layer made of a non-conductive material on which the second electrode is formed.

22. The apparatus as claimed in claim 21, wherein the membrane further comprises an electrically conductive metallic layer which includes the second electrode and springs connected to the second electrode.

23. The apparatus as claimed in claim 22, wherein the membrane further comprises:

a second membrane layer made of a non-conductive material and formed on the second electrode and springs.

24. The apparatus as claimed in claim 23, wherein the first and second membrane layers are made of an organic material.

25. The apparatus as claimed in claim 22, wherein the springs are completely linear.

26. The apparatus as claimed in claim 22, wherein each spring is formed of bent segments.

27. The apparatus as claimed in claim 22, wherein the second electrode has an area less than that of the first membrane layer.

28. The apparatus as claimed in claim 9, wherein in response to the electrostatic force being applied between the membrane and the first electrode, the membrane is moved to increase the volume of the jetting fluid chamber to add the fluid into the jetting fluid chamber, and in response to the electrostatic force being removed, the membrane resiliently moves to a static state to decrease the volume of the jetting fluid chamber and jet the fluid from the jetting fluid chamber.

29. The apparatus as claimed in claim 28, wherein the drive unit further comprises:

a substrate;

an insulating layer formed on the substrate and on which the first electrode is formed; and a spacing barrier layer formed on the insulating layer to maintain a distance between the membrane and the first electrode, the spacing barrier layer having a space formed therein such that the first electrode is formed within the space, and a portion of the membrane moves into the space in response to the electrostatic force.

30. The apparatus as claimed in claim 29, further comprising:

a jetting fluid barrier layer formed on the membrane, to form side walls of the jetting fluid chamber; and a nozzle part having a nozzle plate with a nozzle, to form another wall of the jetting fluid chamber.

31. A method of manufacturing a jetting fluid apparatus, comprising:

forming a first electrode on a first substrate;

forming a space barrier layer on the first substrate and the first electrode and forming a space in the space barrier layer, wherein the first electrode is within the space;

forming a membrane on the space barrier layer, wherein the membrane and the first electrode generate an electrostatic force therebetween in response to a voltage applied therebetween; and forming a jetting fluid chamber on the membrane and corresponding to the first electrode, wherein the first electrode is disposed in an interior of the membrane to exert the electrostatic force to the fluid within the jetting fluid chamber by driving the membrane.

32. The method as claimed in claim 31, wherein the forming of the membrane comprises:

vapor-depositing an electrically conductive metallic layer on a first non-conductive layer; and photo-etching a second electrode and springs into the electrically conductive metallic layer, wherein the springs are connected to the second electrode.

33. The method as claimed in claim 32, wherein the forming of the membrane further comprises:

applying a second non-conductive layer on the second electrode and the springs.

34. The method as claimed in claim 33, wherein the forming of the jetting fluid chamber comprises:

forming a nozzle plate on a second substrate, and forming a nozzle in the nozzle plate;

forming a jetting fluid barrier on the nozzle plate, and forming the jetting fluid chamber in the jetting fluid barrier;

removing the second substrate from the nozzle plate; and adhering the jetting fluid barrier to the second non-conductive layer.

35. The method as claimed in claim 32, wherein the forming of the jetting fluid chamber comprises:

forming a nozzle plate on a second substrate, and forming a nozzle in the nozzle plate;

forming a jetting fluid barrier on the nozzle plate, and forming the jetting fluid chamber in the jetting fluid barrier;

removing the second substrate from the nozzle plate; and adhering the jetting fluid barrier to the second non-conductive layer.

36. The method as claimed in claim 31, further comprising:

forming an insulating layer on the first substrate so that the space barrier layer is formed on the insulating layer;

wherein the forming of the space barrier layer comprises:

applying an organic film on the insulating layer and on the first electrode, and photo-etching the organic film to produce the space barrier layer having the space.

* * * * *